US006434889B1

(12) United States Patent
Jones

(10) Patent No.: US 6,434,889 B1
(45) Date of Patent: Aug. 20, 2002

(54) ANTENNA SUPPORT STRUCTURE WITH PALM TREE SKIRT

(75) Inventor: Douglas Jones, Palm Springs, CA (US)

(73) Assignee: Absolute Stealth Ltd., Napa, CA (US)

( * ) Notice: Subject to any disclaimer, the term of this patent is extended or adjusted under 35 U.S.C. 154(b) by 0 days.

(21) Appl. No.: 09/620,921

(22) Filed: Jul. 21, 2000

(51) Int. Cl.[7] ..... E04H 12/02; E04H 12/00

(52) U.S. Cl. ..... 52/40; 52/651.07; 52/726.4; 52/736.3; 52/738.1; 428/7; 428/20

(58) Field of Search ..... 52/40, 651.02, 52/651.07, 726.4, 736.3, 721.4, 738.1, 651.01; 428/7, 20, 8, 188

(56) References Cited

U.S. PATENT DOCUMENTS

| | | | | | |
|---|---|---|---|---|---|
| 843,171 | A | * | 2/1907 | Petterson | 52/40 |
| 2,099,671 | A | * | 11/1937 | Bairey | 52/40 |
| 2,251,705 | A | | 8/1941 | Gonzalez | |
| 2,698,873 | A | * | 1/1955 | Allsworth et al. | 52/656.01 |
| 2,851,807 | A | * | 9/1958 | Taylor | 428/7 |
| 3,144,375 | A | | 8/1964 | Day | |
| 3,210,232 | A | * | 10/1965 | Wielland | 428/20 |
| 3,829,349 | A | | 8/1974 | Hermanson | |
| 4,068,419 | A | * | 1/1978 | Decoppet | 52/40 |
| 4,855,167 | A | | 8/1989 | Biehl | |
| 5,085,900 | A | * | 2/1992 | Hamlett | 428/18 |
| D340,003 | S | | 10/1993 | Wright et al. | |
| 5,340,622 | A | | 8/1994 | Curitti | |
| 5,611,176 | A | | 3/1997 | Juengert et al. | |
| 5,787,649 | A | * | 8/1998 | Popowych et al. | 52/40 |
| 6,028,566 | A | * | 2/2000 | Pennell et al. | 343/878 |
| 6,122,866 | A | | 9/2000 | Thomas et al. | |
| 6,224,953 | B1 | * | 5/2001 | Johnson | 428/20 |

FOREIGN PATENT DOCUMENTS

| | | | | |
|---|---|---|---|---|
| DE | 2944931 | * | 5/1979 | 428/8 |
| DE | 2923280 | * | 8/1979 | 428/7 |

* cited by examiner

*Primary Examiner*—Carl D. Friedman
*Assistant Examiner*—Phi Dieu Tran A
(74) *Attorney, Agent, or Firm*—Denton L. Anderson; Sheldon & Mak

(57) ABSTRACT

An antenna support structure has the outward appearance of a palm tree. The antenna support structure has a vertical support pole with an upper portion, an intermediate portion and a lower portion. The lower portion is of a color and texture to resemble the trunk of a palm tree. Disposed outwardly from the intermediate portion is a plurality of antenna receptor members appropriately configured to receive desired electromagnetic signal waves. At the top of the support pole is a plurality of green members having the appearance of new palm fronds. Below the green members are a plurality of drooping members disposed downwardly about the intermediate portion of the support pole and covering the antenna receptor members. The drooping members have colors and textures to resemble a palm tree skirt.

14 Claims, 2 Drawing Sheets

ANTENNA SUPPORT STRUCTURE WITH PALM TREE SKIRT

FIELD OF THE INVENTION

This invention relates generally to antenna support structures and, more particularly, to antenna support structures intended to blend in with their surroundings.

BACKGROUND OF THE INVENTION

Antenna support structures are an increasingly common site in both rural and urban neighborhoods. To many, however, antenna support structures are unsightly and significantly detract from the appearance of the landscape.

Attempts have been made to minimize the problem by supporting a multiple of different antenna receptor members on a single support structure (so as to support multiple carriers and thereby minimize the number of support structures cluttering up the landscape). Such attempts at "co-location," however, have not addressed the fundamental problem regarding the perceived ugliness of the support structures themselves.

Attempts have been made to "disguise" antenna support structures as ordinary trees. However, such previous attempts have been largely unsuccessful. In most cases, the resulting appearance of the antenna support structure is unduly artificial and is, therefore, even more unsightly than an ordinary (undisguised) antenna support structure. In those limited cases where tree disguises provide a relatively authentic tree appearance, the structure is unduly complicated, expensive to build and expensive and awkward to maintain.

Also, such prior art attempts to "disguise" antenna support structures have not addressed the problem of how to provide such antenna support structures with multiple antenna receptor types, so as to allow the antenna support structure to support multiple carriers.

Accordingly, there is a need for an antenna support structure which avoids these problems with the prior art.

SUMMARY OF THE INVENTION

The invention satisfies this need. The invention is an antenna support structure comprising (a) a vertical support pole having an upper portion, an intermediate portion and a lower portion, the lower portion being of a color and texture to resemble the trunk of a palm tree, (b) a plurality of antenna receptor members disposed outwardly from the intermediate portion of the support pole, (c) a plurality of green members disposed outwardly about the upper portion of the support pole, the plurality of green members having colors and textures to resemble new palm fronds, and (d) a plurality of drooping members disposed downwardly about the intermediate portion of the support pole, the plurality of drooping members having colors and textures to resemble a palm tree skirt, wherein the plurality of drooping members covers the antenna receptor members, so that the antenna support structure has the outward appearance of a palm tree.

In a typical embodiment, the invention further comprises at least one support member projecting outwardly from the intermediate portion of the support pole. A support lattice is disposed around the support member to provide attachment sites for the plurality of drooping members.

DESCRIPTION OF THE DRAWINGS

These and other features, aspects and advantages of the present invention will become better understood with reference to the following description, appended claims and accompanying drawings where:

DETAILED DESCRIPTION

Figure 1:
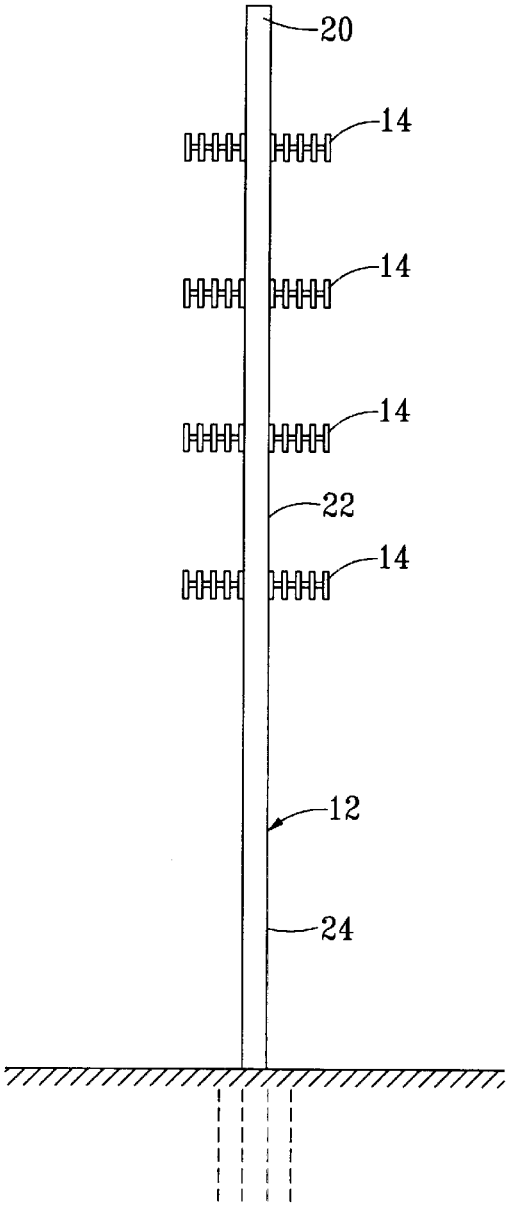
FIG. 1 PRIOR ART
FIG. 1 is a side view of an antenna support structure of the prior art.
Figure 4:
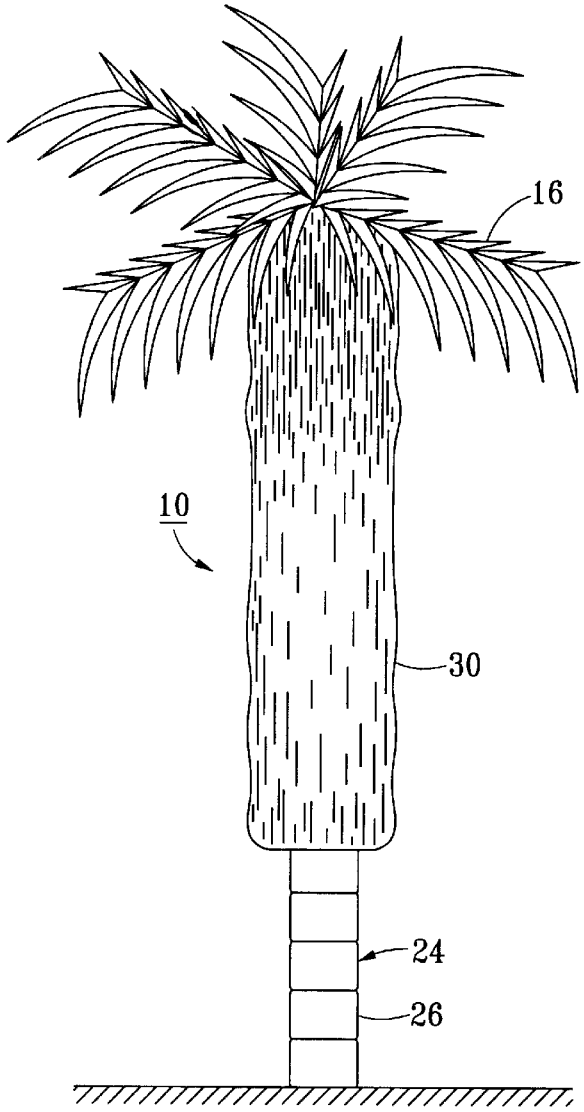
FIG. 4 is a side view of the antenna support structure of FIGS. 2 and 3 having additional features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is an antenna support structure 10 comprising a support pole 12, a plurality of antenna receptor members 14, a plurality of green members 16 and a plurality of drooping members 18.

The support pole 12 is typically a hollow metal structure having sufficient strength and rigidity to support the various other components of the invention. In a typical embodiment, the base of the support pole 12 is about 6 feet in diameter is about 75 feet in height.

The support pole 12 has an upper portion 20, an intermediate portion 22 and a lower portion 24. In the embodiment illustrated in the drawings, the upper portion 20 constitutes the uppermost foot or two. In embodiments wherein the support pole 12 has a nominal height of about 75 feet, the intermediate portion 22 typically constitutes about 55 feet and the lower portion 24 constitutes the remaining 18 feet.

The lower portion 24 of the support pole has a color and texture adapted to resemble the trunk of a palm tree. In a typical embodiment, this is accomplished by wrapping the lower portion 24 of the support pole 12 with a covering 26 made from a plastic material, such as a polyurethane. The covering 26 is duly textured and colored to resemble the trunk of a palm tree. In most cases, the resulting color of the lower portion 24 of the support pole 12 will comprise varying shades of tan and brown.

The plurality of antenna receptor members 14 are disposed outwardly from the intermediate portion 22 of the support pole 12. In a typical embodiment, the invention comprises several antenna receptor members 14 spaced apart at varying levels about the intermediate portion 22 of the support pole 12. Each of the antenna receptor members 14 is adapted in material and structure to receive whatever electromagnetic signal waves the invention is intended to receive. Any of the many prior art designs of antenna receptor members 14 can be adapted for use in the invention. The invention provides sufficient pole length to accommodate different antenna receptor members 14, so as to allow the antenna support structure 10 to accommodate multiple carriers. In a typical embodiment, several "tiers" of differing antenna receptor members 14 can be conveniently vertically spaced apart by 10–20 feet between tiers. Such vertical spacing is generally required for multiple carriers. Thus, the antenna support structure 10 has the unique capability of providing for co-location of differing antenna functions (thereby minimizing the number of support structures which must be built within a neighborhood), while allowing for the "disguise" of the support structure 10 as a natural and aesthetically pleasing palm tree.

Typically, the antenna receptor members 14 are made from a metal. In all cases, the antenna receptor members 14 are electrically connected to electronic signal reception equipment (not shown).

The plurality of green members 16 are disposed outwardly about the upper portion 20 of the support pole 12. In the embodiment illustrated in the drawings, the green members 16 are attached to the upper portion 20 by a retaining pin 28. In a typical embodiment wherein the length of the support pole 12 is about 75 feet, the green members 16 extended upwardly a further distance of between about 5 feet and about 15 feet.

The green members 16 have colors and textures to resemble new palm fronds. By the term "new palm fronds," it is meant green palm tree leaves disposed at the uppermost portions of typical living palm trees. The green members 16 are also preferably shaped to resemble new palm fronds. In a typical embodiment of the invention, the green members 16 are made from a plastic material, such as acrylonitrile styrene acrylate.

The drooping members 18 are disposed outwardly about the intermediate portion 22 of the support pole 12 in a way calculated to hide the antenna receptor members 14. The drooping members 18 have colors and textures adapted to give the plurality of drooping members 18 the appearance of a palm tree skirt 30. By the term "palm tree skirt," it is meant that portion of a typical living palm tree made up of drooping brown palm fronds disposed downwardly below the green new palm fronds at the uppermost portion of the palm tree. Accordingly, in a typical embodiment of the invention, the colors of the drooping members 18 are varying shades of tan and brown.

The drooping members 18 are preferably strips of a plastic material, such as acrylonitrile styrene acrylate. The strips are typically between about one foot and about three feet in length and between about ¼ inch and about 1 inch in width. Other lengths and widths can be used, as well, so long as the overall visual effect of the plurality of drooping members 18 is that of a palm tree skirt 30. The drooping members 18 can be of a uniform length or they can be of differing lengths.

It is important in the overall construction of the drooping members 18 that they are sufficiently light to flutter slightly in the breeze, but not so slight as to suffer damage from the wind or to flutter so briskly so as to frequently expose the plurality of antenna receptor members 14.

In a preferred embodiment of the invention, the drooping members 18 are hung from a support lattice 32 disposed around the intermediate portion 22 of the support pole 12. In the embodiment illustrated in the drawings, the support lattice 32 is disposed about a plurality of spaced-apart support members 34 which project outwardly from the support pole 12. Preferably, the support members 34 project outwardly from the support pole 12 a distance slightly greater than the distance to which the antenna receptor members 14 project outwardly from the support pole 12. By this design, the cooperation of the support lattice 32 and the support members 34 totally encompass the plurality of antenna receptors 14.

The support members 34 typically comprise three or four outwardly projecting spokes radially connected at their distal-most ends by a circular circumscribing member 36. The support members 34 can alternatively comprise solid or perforated disks 37. In all cases, the support members 34 preferably comprise a plurality of hanger elements 38 to support and retain in place the support lattice 32.

The support lattice 32 is typically made from a non-metallic material, such as a nylon cord. Nylon cord having one eighth inch diameter strands has been found to be advantageously useable in the invention. The support lattice 32 need not be a true lattice structure, but it must provide a plurality of vertically spaced-apart horizontal tie-off members 40 to which the plurality of drooping members 18 can be conveniently attached. The support lattice 32 must also comprise a plurality of radially spaced-apart vertical members 42 sufficient to properly support the plurality of tie-off members 40. Hence, a true lattice structure, such as illustrated in the drawings, is a typical configuration of the support lattice 32.

Figures 2, 3, 5:
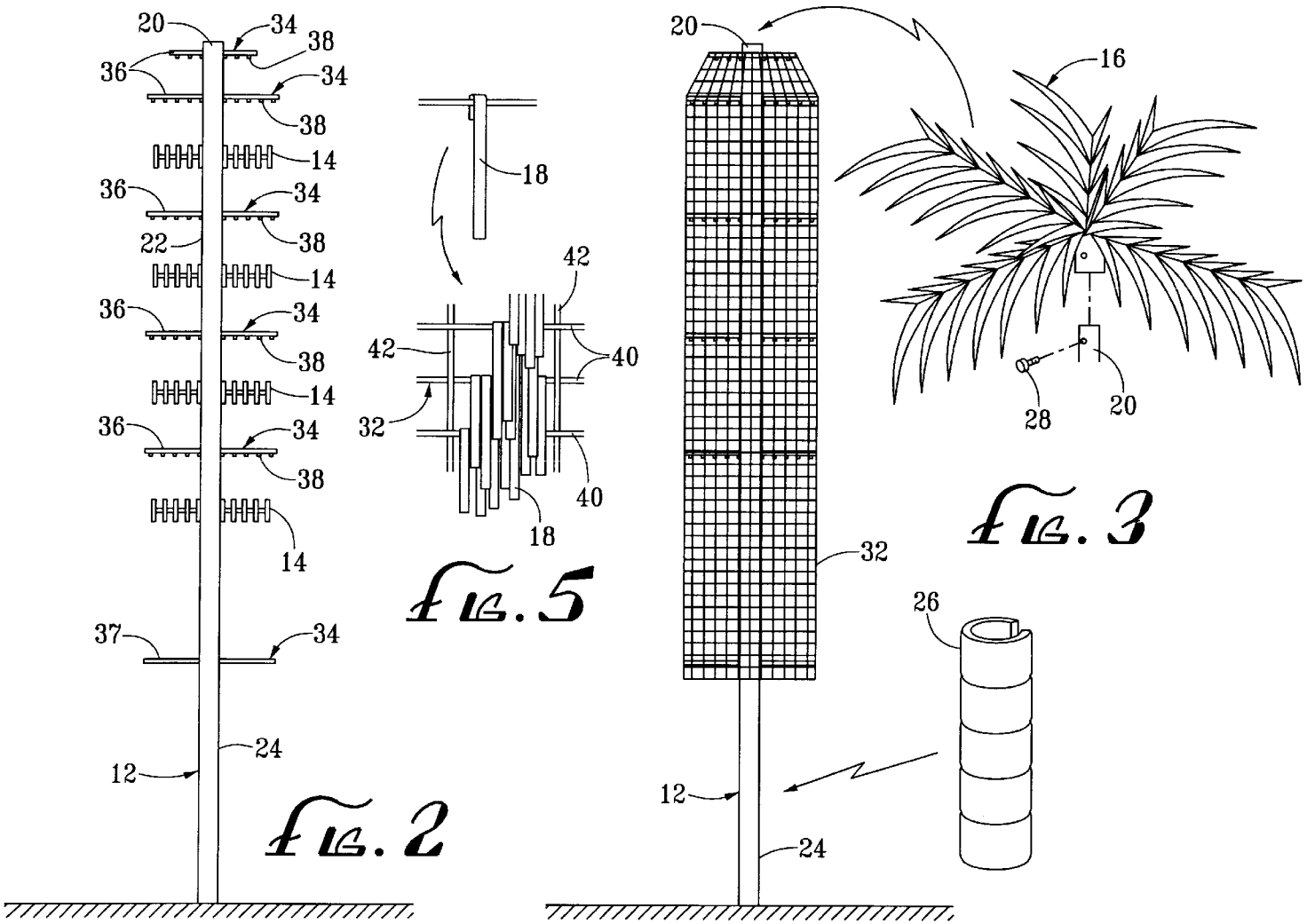
FIG. 2 is a side view of an antenna support structure having features of the invention.
FIG. 3 is a side view of the antenna support structure of FIG. 2 having additional features of the invention.
FIG. 5 is an isometric detail view of drooping members useable in the invention.

As illustrated in FIG. 5, the drooping members 18 can be attached individually to the tie-off members 40 of the support lattice 32. Each drooping member 18 can be attached to a tie-off member 40 by folding the uppermost portion of the drooping member 18 around a tie-off member 40 and attaching the drooping member 18 to itself via any suitable attachment means, such as by mechanical fasteners, contact cements or heat treatments. Typically, the plurality of drooping members 18 are attached to the support lattice 32 in a random fashion, so as to enhance the overall visual impression of a palm tree skirt 30.

Unlike most antenna "disguises" of the prior art, the antenna support structure of the invention is inexpensive to construct and maintain. Repair and modification to the plurality of antenna receptor members is easily accomplished by simply removing the lattice support from the support pole to fully expose all of the antenna receptor members. When such repair or modifications are complete, the antenna support structure is easily and inexpensively reassembled by merely reattaching the lattice support to the support pole.

Also unlike most antenna "disguises" of the prior art, the antenna support structure of the invention provides a simple and easy way to provide sufficient spacing between different antenna receptor members so as to allow the antenna support structure to accommodate multiple carriers.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. An antenna support structure comprising:

(a) a vertical support pole having an upper portion, an intermediate portion and a lower portion, the lower portion being of a color and texture to resemble the trunk of a palm tree;

(b) a plurality of antenna receptor members disposed outwardly from the intermediate portion of the support pole;

(c) a plurality of green members disposed outwardly about the upper portion of the support pole, the plurality of green members having colors and textures to resemble new palm fronds; and (d) a plurality of drooping members disposed downwardly about the intermediate portion of the support pole, the plurality of drooping members having colors and textures to resemble a palm tree skirt;

wherein the plurality of drooping members covers the antenna receptor members, so that the antenna support structure has the outward appearance of a palm tree.

2. The antenna support structure of claim 1 wherein the intermediate portion of the support pole further comprises at least one outwardly projecting support member and a support lattice disposed around the at least one support member, the drooping members being attached to the support lattice.

3. The antenna support structure of claim 1 wherein the drooping members are made of a plastic material.

4. The antenna support structure of claim 1 wherein the drooping members have a length between about one foot and about three feet.

5. The antenna support structure of claim 1 wherein the drooping members have a width between about ¼ inch and about one inch.

6. The antenna support structure of claim 1 wherein the support pole further comprises a covering which is colored and textured to resemble the trunk of a palm tree.

7. The antenna support structure of claim 1 wherein the plurality of antenna receptor members are disposed in at least two spaced-apart tiers, wherein the tiers are vertically spaced apart by a distance of between about 10 feet and about 20 feet.

8. The antenna support structure of claim 1 wherein the plurality of antenna receptor members comprise at least two different types of antenna receptor members, so that the antenna support structure supports multiple carriers.

9. An antenna support structure comprising:

(a) a vertical support pole having an upper portion, an intermediate portion and a lower portion, the lower portion having a covering which is colored and textured to resemble the trunk of a palm tree;

(b) a plurality of antenna receptor members disposed outwardly from the intermediate portion of the support pole;

(c) at least one outwardly projecting support member projecting outwardly from the intermediate portion of the support pole;

(d) a support lattice disposed around the at least one outwardly projecting support member;

(e) a plurality of green members disposed outwardly about the upper portion of the support pole, the drooping members having a length between about one foot and about three feet, the green members having colors and textures to resemble new palm fronds; and (f) a plurality of drooping members disposed downwardly from the support lattice, the plurality of drooping members each being between about 1 foot and about 3 feet in length, and having colors and textures to collectively resemble a palm tree skirt;

wherein the plurality of drooping members covers the antenna receptor members, so that the antenna support structure has the outward appearance of a palm tree.

10. The antenna support structure of claim 9 wherein the drooping members are made of a plastic material.

11. The antenna support structure of claim 9 wherein the drooping members have a width between about ¼ inch and about one inch.

12. The antenna support structure of claim 9 wherein the covering is made from a plastic material.

13. The antenna support structure of claim 9 wherein the plurality of antenna receptor members are disposed in at least two spaced-apart tiers, wherein the tiers are vertically spaced apart by a distance of between about 10 feet and about 20 feet.

14. The antenna support structure of claim 9 wherein the plurality of antenna receptor members comprise at least two different types of antenna receptor members, so that the antenna support structure supports multiple carriers.

* * * * *